US005949034A

United States Patent [19]

Kim

[11] Patent Number: 5,949,034

[45] Date of Patent: Sep. 7, 1999

[54] ABSORPTIVE SILENCER FOR USE IN A COMPRESSOR

[75] Inventor: Ki-Baek Kim, Suwon, Rep. of Korea

[73] Assignee: Samsung Electronics Co., Ltd., Suwon, Japan

[21] Appl. No.: 09/086,511

[22] Filed: May 28, 1998

[30] Foreign Application Priority Data

May 31, 1997 [KR] Rep. of Korea ..... 97-22531

[51] Int. Cl.[6] ..... F02M 35/00

[52] U.S. Cl. ..... 181/229; 181/403

[58] Field of Search ..... 181/403, 229, 181/246, 282; 417/312

[56] References Cited

U.S. PATENT DOCUMENTS 4,784,581 11/1988 Fritchman ..... 417/312
5,304,044 4/1994 Wada et al. ..... 181/403

*Primary Examiner*—Khanh Dang
*Attorney, Agent, or Firm*—Burns, Doane, Swecker & Mathis, L.L.P.

[57] ABSTRACT

An absorptive silencer is used in a compressor which compresses a mixture of HFC-134*a* refrigerant and ester-based refrigeration oil. The silencer consists of low oligomer type of PBT resin 64.8–0.2%, to thereby improve a refrigeration efficiency.

3 Claims, 4 Drawing Sheets

ABSORPTIVE SILENCER FOR USE IN A COMPRESSOR

BACKGROUND OF THE INVENTION

1. Field of the Invention

The present invention relates to a compressor and more particularly to an absorptive silencer of a compressor.

2. Description of the Prior Art

Generally, a compressor is used in a refrigeration cycle and the compressor comprises, as illustrated in FIG. 1, a stator 20, a rotor 21 and an eccentric unit 16*a* formed at an end of a crank shaft 16.

The eccentric unit 16*a* of the crank shaft 16 is attached to a connecting rod 11 for changing a rotary motion of the crank shaft 16 to a reciprocating motion and the connecting rod 11 is coupled to a piston 12 by a piston pin 13. The piston 12 repeats absorption and compression of refrigerant in a cylinder block 70.

The cylinder block 70 is coupled to a cylinder head unit 90 by a coupling bolt (not shown), and an absorptive silencer 100 is provided at a refrigerant inlet side of the unit go to reduce noise generated when the refrigerant is sucked from outside by reciprocation of the piston 12.

The material of the absorptive silencer 100 is polybutylene terephthalate (PBT), which consists of PBT resin, glass fiber (30%), coupling agent (0.1%) and paraffin wax (0.3%), where the coupling agent is silicone oil.

The glass fiber is used in the composition of PBT for fire-resistance, and the coupling agent is used for achieving good mixture between PBT resin and glass fiber, and the paraffin wax is an additive for producing good extrusion.

Sometimes, hydrofluoro carbon-12 (HFC-12, $C_2F_4H_2$-12) is used as a refrigerant, which is a good material for use in a compressor, and a mineral oil-based refrigeration oil is used sometimes in that refrigerant.

However, as a way to protect the earth environment, hydrofluoro carbon-134a (HFC-134a, $C_2F_4H_2$-134a) is currently used as a refrigerant, and esther-based refrigeration oil is used. When refrigerant and oil thus described are used in a reciprocating compressor having an absorptive silencer extruded from PBT, the PBT resin and the esther-based refrigeration oil react to generate oligomer which blocks the refrigerating cycle, i.e., a phenomenon of blocking a capillary tube occurs.

Furthermore, the capillary tube is clogged by the mixture of paraffin wax and esther-based refrigeration oil, which reduces the refrigeration efficiency or provides a cause of refrigerator glitch.

SUMMARY OF THE INVENTION

The present invention is disclosed to solve the aforementioned problem and it is an object of the present invention to provide an absorptive silencer of a compressor using HFC-134a as refrigerant and esther-based refrigeration oil as oil.

In accordance with the object of the present invention, there is provided an absorptive silencer, the material thereof composed of low oligomer type of polybutylene terephthalate resin 64.8–74.99%, glass fiber 25–35% and coupling agent 0.01–0.2%.

Particularly, the material of the absorptive silencer consists of dimethyl terephthalate, 1.4-butanediol estherificated low oligomer type of poly-butylene terephthalate resin 69.9%, glass fiber 30% and coupling agent 0.1%.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF THE INVENTION

Hereinafter, the present invention will be described in detail with reference to the accompanying drawings.

A refrigeration cycle of a refrigerator consists of a compressor, condenser, expander (capillary tube) and an evaporator, and a refrigerant currently used for this cycle is hydrofluoro carbon-134a (HFC-134a, $C_2F_4H_2$-134a) in order to protect earth environment, and esther-based refrigeration oil is used.

The refrigerant thus described is 1.1.1-tetrafluoro-ethanol containing no chlorine, and the esther-based oil contains more than two esther combination, which has a viscosity of 2–35 cSt (centi stoke) at a temperature of at 40 degrees celsius. The oil also refers to more than two aliphatic acid esther oil having a viscosity of 1–6 cSt at a temperature of 100 degrees celsius.

Furthermore, the above-mentioned esther-based oil is an oil utilizing an alcohol such as branched aliphatic acid having 2–10 numbers of carbon atoms, Neopenthyl glycol, and pentaery thritol and an additive such as hydrolytic stabilizer, oxidation stabilizer and foaming agent.

The PBT material used for an absorptive silencer of a compressor utilizing the above-mentioned refrigerant and esther-based refrigeration oil, consists of a low oligomer type of polybutylene terephthalate (PBT) resin 64.8–74.99% obtainable by a formula 1 below, glass fiber 25–35% and coupling agent 0.01–0.2%.

It is advisable for the PBT to contain a low oligomer type of poly-butylene terephthalate (PBT) resin 69.9%, glass fiber 30% and coupling agent 0.1%, where the coupling agent is silicon-based oil.

In other words, the low oligomer type of PBT resin is formed by esther substitution of 1.4-butanediol and dimethyl terephthalate Formula 1

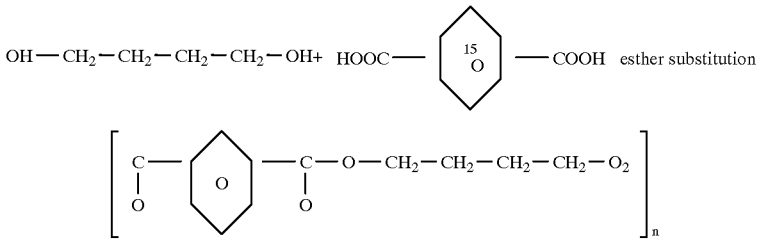

Now, an operational effect of an absorptive silencer of a reciprocating compressor thus constructed according to the present invention will be described in detail.

At present, a refrigerant of HFC-134a and an esther-based oil are used for the refrigeration cycle of a refrigerator in order to protect earth environment.

As explained earlier, when the above-described refrigerant and refrigeration oil are used in an absorptive silencer of a conventional compressor, the PBT resin and paraffin wax act as blocking elements in a capillary tube in a refrigeration cycle to thereby reduce a reliability thereof. In contrast, the present invention uses a low oligomer type of PBT resin utilizing no paraffin wax to thereby increase a refrigeration efficiency.

In other words, when an absorptive silencer made of a conventional PBT is used in a compressor utilizing HFC-134a and esther-based refrigeration oil, a phenomenon of blocking a capillary tube of the refrigeration cycle occurs to downgrade the quality of a refrigerator.

Figure 1:
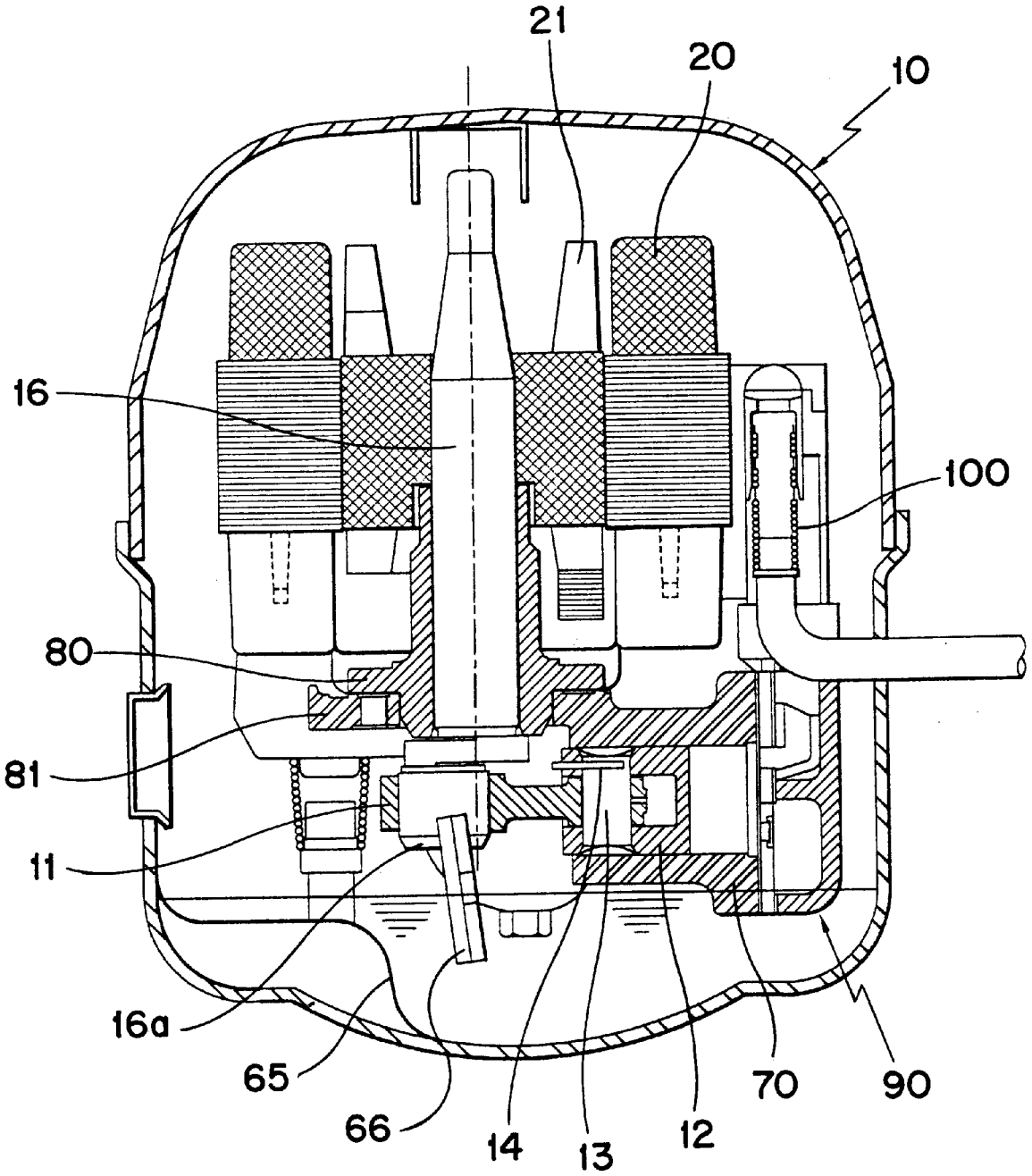
FIG. 1 (PRIOR ART)
FIG. 1 is a longitudinal sectional view of a conventional reciprocating compressor.
Figure 2A:
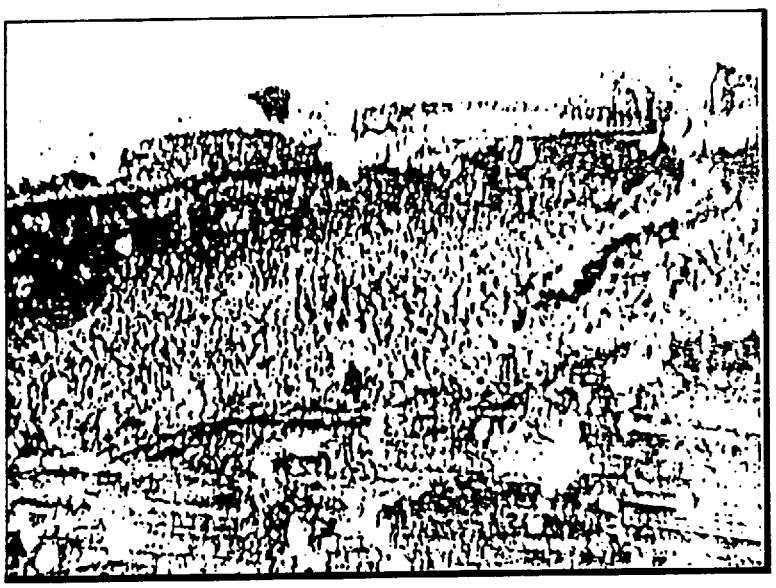
FIG. 2A (PRIOR ART)
FIG. 2A is a schematic diagram for illustrating the interior of a capillary tube after the life of the capillar tube is tested at a refrigerating cycle utilizing a reciprocating compressor having a conventional absorptive silencer.

As illustrated in FIG. 2A, when a capillary tube is dissected and an inner area thereof is photographed by an imagelizer after the life of a compressor utilizing an absorptive silencer extruded of the conventional PBT, white foreign objects were detected at an outlet side of the capillary tube.

Figure 3:
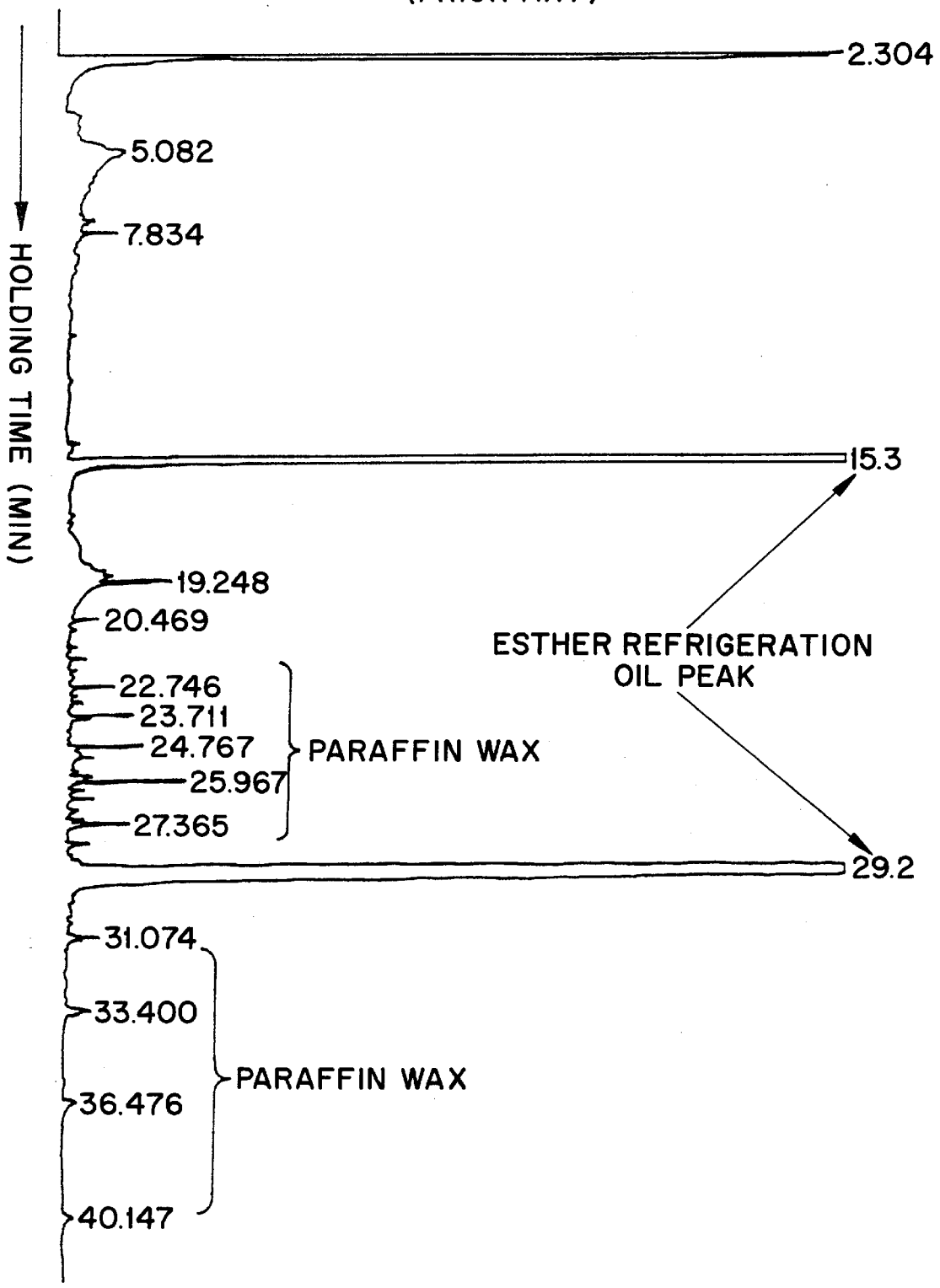
FIG. 3 (PRIOR ART)
FIG. 3 represents the results of a gas chromatograph analysis after foreign objects are removed from the interior of a capillary tube by N-hexane at a refrigeration cycle utilizing a reciprocating compressor having a conventional absorptive silencer.
Figure 4:
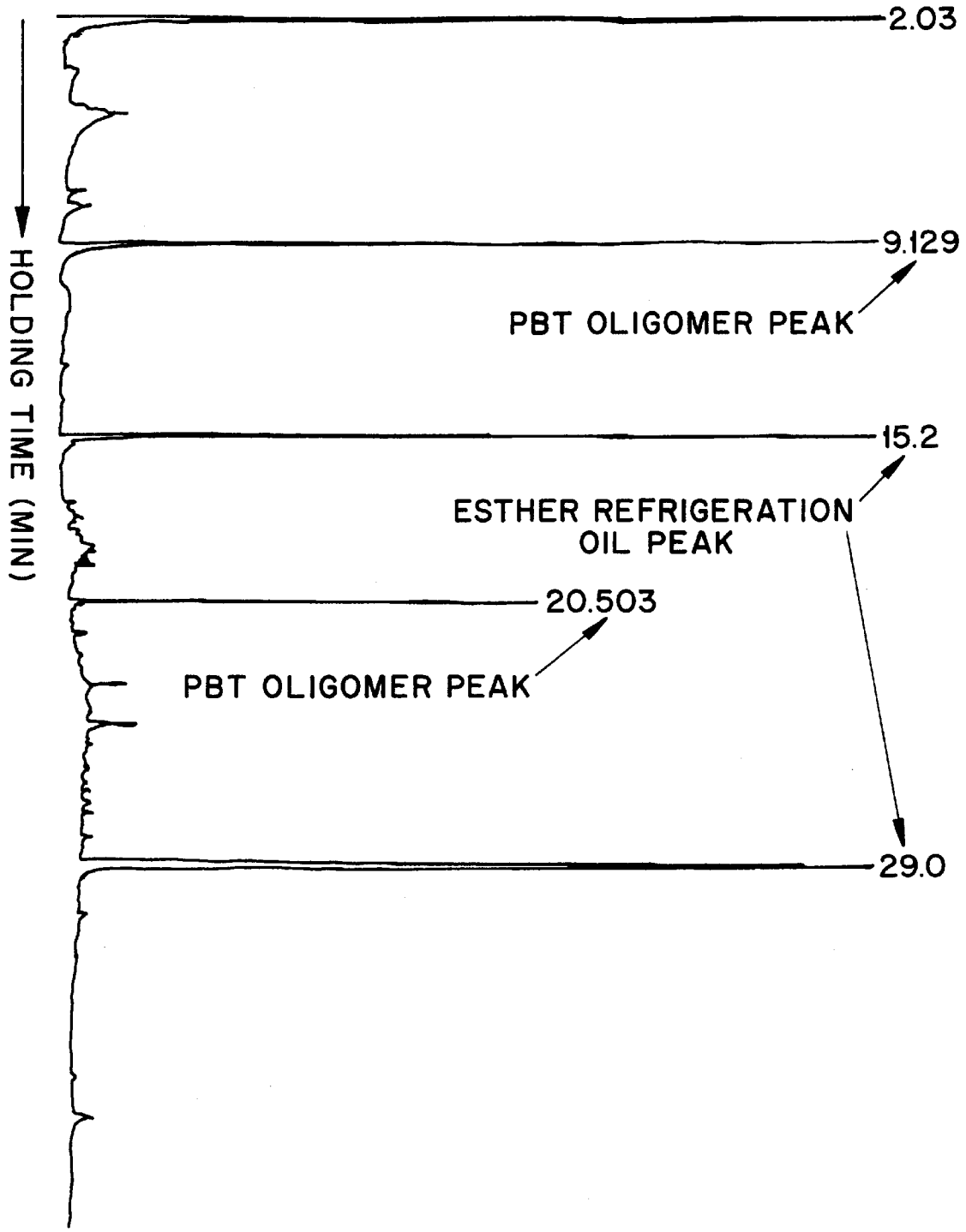
FIG. 4 (PRIOR ART)
FIG. 4 represents the results of a gas chromatography after foreign objects are removed from the interior of a capillary tube by methylenechloride at a refrigeration cycle utilizing a reciprocating compressor having a conventional absorptive silencer.

When these white foreign objects are extracted by n-hexane and analyzed by a gas chromatograph (GC), paraffin wax was detected as illustrated in FIG. 3. When these foreign objects were extracted by methylene chloride and analyzed by a gas chromatograph (GC), oligomer generated from PBT was detected.

In other words, when solution extracted by hexane was analyzed by a gas chromatograph (GC), PBT oligomer was not detected. When a solution extracted by methylene chloride was analyzed by a gas chromatograph (GC), paraffin wax was not detected. This means that a solvent having low polarity such as hexane dissolves paraffin wax of low polarity but does not dissolve PBT oligomer of high polarity, and that methyl chloride which is a solvent of high polarity dissolves PBT oligomer of high polarity.

As can be concluded from the above discussion, a reciprocating compressor equipped with an absorptive silencer made of conventional PBT has a problem in that a capillary tube of the refrigeration cycle is clogged by PBT oligomer and paraffin wax to thereby downgrade a refrigeration efficiency.

Figure 2B:
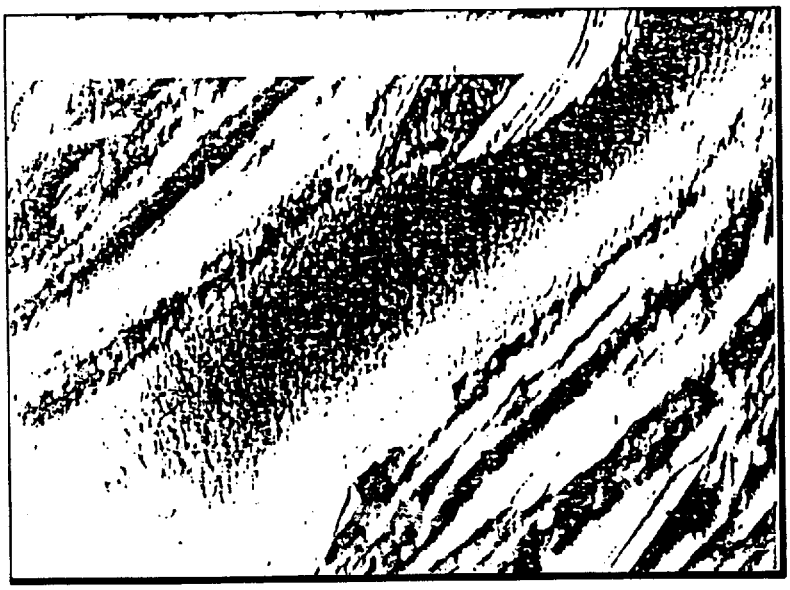
FIG. 2B is a schematic diagram for illustrating the interior of a capillary tube after the life of the capillary tube is tested at a refrigeration cycle utilizing a reciprocating compressor having an absorptive silence according to the present invention.

Meanwhile, when a reciprocating compressor equipped with an absorptive silencer made of PBT according to the present invention is life-tested by the method thus mentioned, and a capillary tube is dissected and an inner area thereof is photographed by an imagelizer, no foreign objects were detected as illustrated in FIG. 2B.

Accordingly, it is advisable that a compressor utilizing HFC-134a and esther-based refrigeration oil uses an absorptive silencer made of a low oligomer type of PBT resin utilizing no paraffin wax.

As is apparent from the foregoing, the invention provides an advantage in an absorptive silencer of a compressor utilizing HFC-134a as refrigerant and esther-based refrigerant oil, in that the refrigeration efficiency is upgraded.

What is claimed is:

1. An absorptive silencer adapted for use in a compressor which compresses a mixture of HFC-134a refrigerant and esther-based refrigeration oil, the silencer consisting of low oligomer type of polybutylene terephthalate (PBT) resin 164.8–74.99%, glass fiber 25–35% and coupling agent of 0.01–0.2%.

2. The silencer as defined in claim 1, wherein the silencer consists of low oligomer type of PBT resin 69.9%, glass fiber 30% and coupling agent 0.1%.

3. The silencer as defined in claim 1, wherein the low oligomer type of PBT resin is formed by esther-substituted 1.4-butanediol and dimethyl terephthalate.

* * * * *